US006225959B1

(12) United States Patent
Gordon

(10) Patent No.: US 6,225,959 B1
(45) **Date of Patent: *May 1, 2001**

(54) DUAL FREQUENCY CAVITY BACKED SLOT ANTENNA

(75) Inventor: Eldon L. Gordon, Sachse, TX (US)

(73) Assignee: Raytheon Company, Lexington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/397,024

(22) Filed: Mar. 1, 1995

Related U.S. Application Data

(63) Continuation of application No. 08/109,802, filed on Aug. 20, 1993, now abandoned.

(51) Int. Cl.[7] ..... H01Q 13/00; H01Q 1/38

(52) U.S. Cl. ..... 343/769; 343/700 MS

(58) Field of Search ..... 343/767, 769, 343/789, 70 MS, 746; H01Q 1/38, 13/00

(56) References Cited

U.S. PATENT DOCUMENTS 2,983,919 5/1961 Siukola et al. .
3,573,834 * 4/1971 McCabe ..... 343/769
4,291,312 9/1981 Kaloi .
5,194,876 * 3/1993 Schnetzer et al. ..... 343/769
5,461,393 * 10/1995 Gordon ..... 343/769

FOREIGN PATENT DOCUMENTS 0 250 832 1/1988 (EP) .

OTHER PUBLICATIONS

I. Ping Yu, NASA Tech Brief NTN–77/0801 (MSC–16100), "Low–Cost Dual–Frequency Microwave Antenna", Lyndon B. Johnson Space Center, Houston, Texas, Winter, 1976.

* cited by examiner

*Primary Examiner*—Michael C. Wimer
(74) *Attorney, Agent, or Firm*—Baker Botts L.L.P.

(57) ABSTRACT

A dual frequency cavity backed slot antenna and method of tuning the antenna, wherein the antenna comprises a plurality of stacked layers including a layer having a substrate with an accessible surface, the surface including thereon a continuous slot, first electrically conductive metallization disposed within the slot and extending to the slot, second electrically conductive metallization disposed external to the slot and at least one pair of frequency adjusting devices, one such device associated with the first metallization and the other device associated with the second metallization. The device pairs are either a foil and a tab, a pair of foils or a pair of indentations, one in each of the metallizations.

15 Claims, 3 Drawing Sheets

FIG. 2
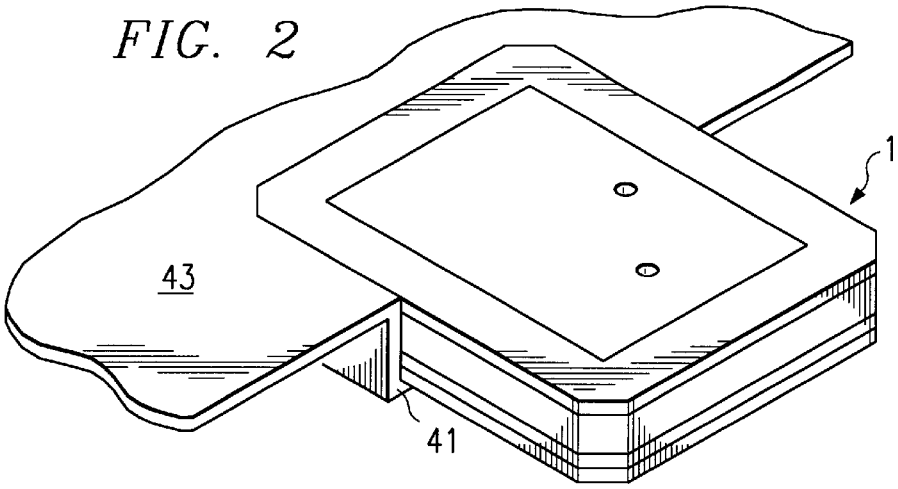
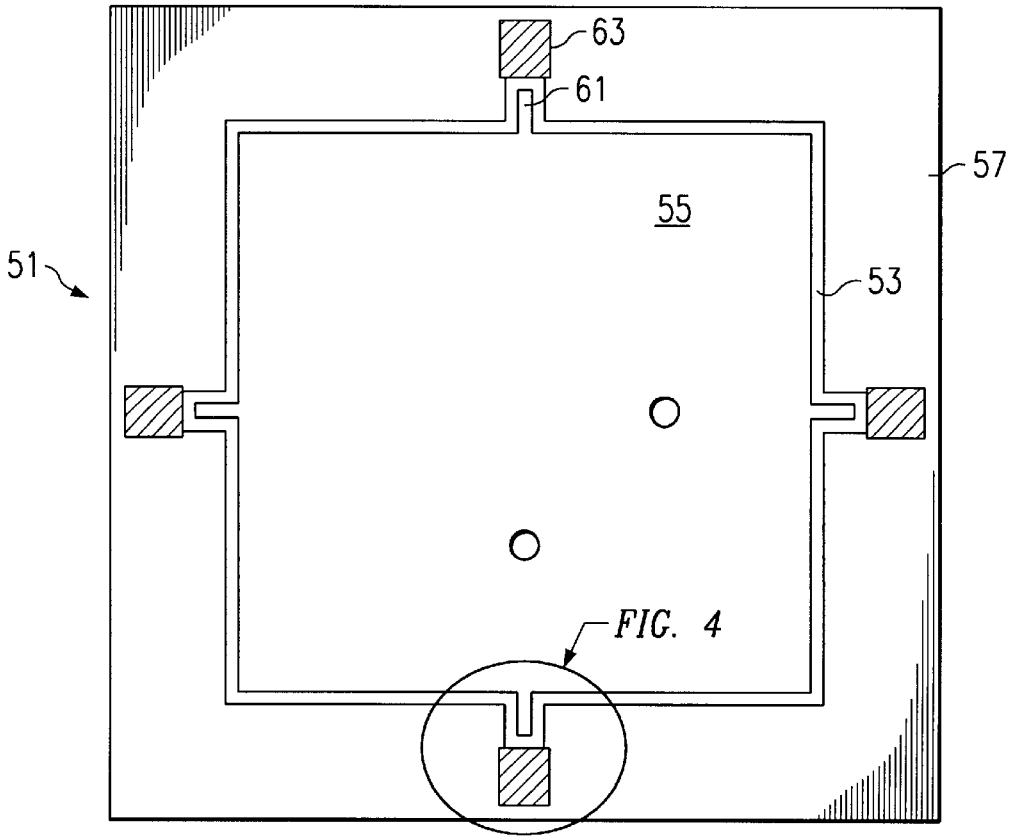
FIG. 3

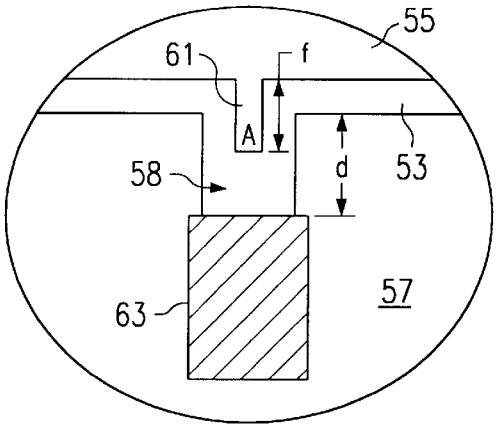
FIG. 4
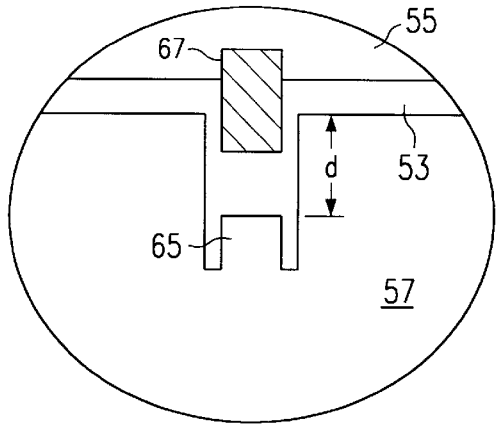
FIG. 5
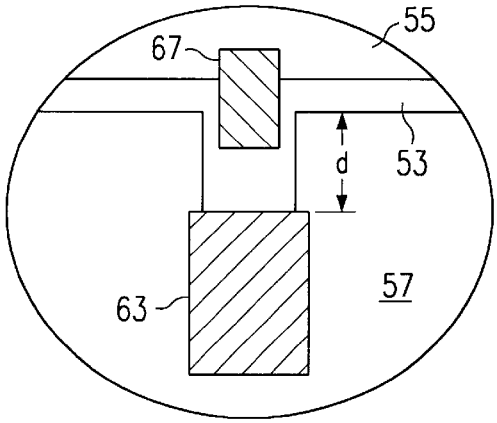
FIG. 6
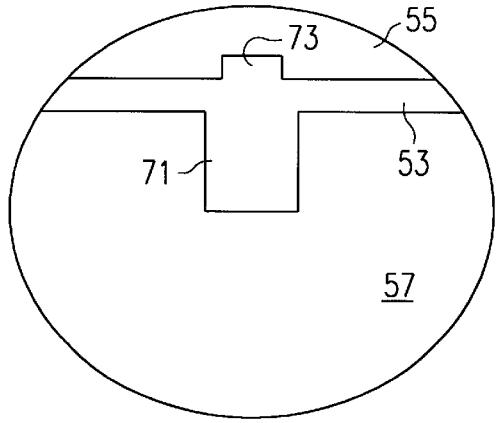
FIG. 8
FIG. 7
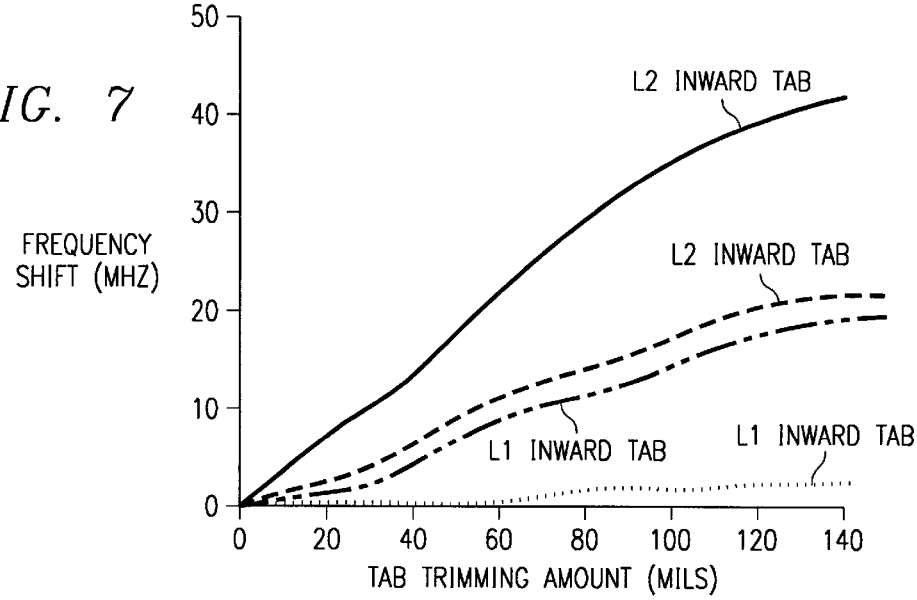

DUAL FREQUENCY CAVITY BACKED SLOT ANTENNA

This application is a Continuation of application Ser. No. 08/109,802, filed Aug. 20, 1993, now abandoned.

BACKGROUND OF THE INVENTION

1. Field of the Invention

This invention relates to dual frequency cavity backed slot antennas and, more specifically, to such antennas which can be accurately tuned for operation at both operating frequencies by adjustment made at a single accessible surface thereof.

2. Brief Description of the Prior Art

Dual frequency cavity backed slot antennas are multilayer microstrip antennas that operate at two separate frequencies. Such antennas are mounted on a ground plane which has an opening around the edges having a width and length selected according to the desired frequency characteristics of the antenna. A first top resonant microstrip layer is aligned in the plane of the ground plane and has a width and length less than the opening in the ground plane. Feed throughs electrically connect the microstrip element to a feed network. A container formed of a bottom and two sidewalls surrounds the antenna. Separating the first top resonant microstrip element from a bottom ground plane is a second resonant microstrip element mounted parallel to the first top microstrip element and electrically coupled to the feed probes. The container is electrically connected to the ground plane. The radiation slot or separation is the difference in the dimensions of the resonant microstrip elements and the opening or edges of the ground plane. The radiation slot may be covered with a thin membrane or microwave absorber.

At each frequency, the antenna circuit described above has very high quality factor (Q) which yields a narrow bandwidth. Because of material and manufacturing process variations, the resonant frequency or frequencies may offset from the desired operating frequency or frequencies. This is not a problem for one of the two resonant frequencies since the top resonant microstrip circuit is readily accessible and can be tuned after assembly to its selected resonant frequency. However, the second element is not accessible and therefore cannot be tuned subsequent to manufacturing assembly. It is therefore apparent that there exists the need of a capability to fine tune the antenna to either or both resonant frequencies of the antenna after the manufacturing assembly is complete.

There is no known published prior art relating to tuning a dual frequency cavity backed slot antenna. While stacked microstrip patch antennas are known and, at first glance may appear to be similar to dual frequency cavity backed slot antennas, these antennas differ from each other very significantly. In the stacked patch antenna, the metallized area on the upper layer does not extend to the edge. Therefore, no slot is formed on the first circuit layer. The metallization on the first circuit layer is then similar to that on the second circuit layer. There is no conductive cavity. In addition, the stacked patch antenna is usually mounted in the host with its bottom side flush with the host surface. This results in an antenna which forms a protrusion on the host surface. In contrast, the cavity backed dual frequency slot antenna mounts in the host flush with the host upper surface, in a conformal manner therewith and is surrounded by a conductive cavity. There is no protrusion above the host surface.

A somewhat successful attempt to solve the above described problems has been provided by fine tuning to both of the resonant frequencies ($L_1$ and $L_2$) of the antenna by simple adjustment to only the circuit on the first circuit layer. This is accomplished by providing a dual frequency cavity backed slot antenna which includes four levels. The topmost level or first circuit layer comprises a dielectric substrate having an upper metallized surface with an unmetallized continuous slot in the metallized surface. One of the resonant frequencies, $L_1$, at which the antenna operates is primarily determined by the dimensions of the metallized region within the continuous slot. The metallization exterior to the slot extends to the edge of the upper surface of the substrate and forms a ground plane which extends to the ground plane of the host surface. The second level, which is adjacent to the topmost level, is composed of a dielectric substrate with a metallic layer thereon and acts as a tuning septum as opposed to a patch and is sized considerably differently than it would be for a stacked patch antenna. The back side of the second level is also fully metallized except for feed probe access. The dimensions of the metallic layer on the second level primarily determine the other of the resonant frequency, $L_2$, at which the antenna operates. The second level has no slot and does not extend to the edges of the substrate. The third and fourth layers are stripline hybrids and provide a circuit which drives the antenna in circular polarization mode. These layers have no impact on frequency tuning. There are two feed points on the antenna. One feed point drives the antenna in the x-direction and the other feed point drives the antenna in the y-direction. The two modes are combined in a 90 degree hybrid to produce circular polarization. Feed throughs extend to the topmost level, one for each axis. When the antenna is mounted in the host, its upper surface is mechanically flush with and electrically continuous therewith. The conductive cavity completely encloses the antenna. All metallization is electrically conductive, usually copper.

Tuning adjustment is provided on the topmost level or first circuit layer by altering the area of both the metallized region within the slot and the metallized region external to the slot. This is accomplished by providing tabs on both the metallized region within the slot and the metallized region external to the slot and then adjusting the dimensions of the tabs by subtracting or trimming metal from each of the tabs. The tab on the metallized region within the slot extends toward the metallized region external to the slot and the tab on the metallized region external to the slot extends toward the metallized region within the slot. Two adjacent contiguous tabs extending in opposite direction from each side of the slot do not provide desired results due to phasing error of the non-symmetrical design. It follows that symmetry of design is important. There can be more than one tab extending from either or both the metallized region within the slot or the metallized region external to the slot. If plural tabs are provided on any region, they are preferably but not necessarily symmetrically arranged with respect to each other. When plural tabs are provided from either or both of the regions, trimming of tab dimensions is preferably but not necessarily provided on a symmetrical basis. The tab sides are preferably spaced from or have slots therealong to assist in determining the amount of tab removed. If the topmost level is rectangular and the metallization within the slot is also rectangular, when x and y axes provide four equally dimensioned portions in the metallization within the slot, one feed through will be positioned along the x axis and the other feed through will be positioned along the y axis, both spaced equally from the intersection of the x and y axes.

In operation, the four levels of the dual frequency cavity backed slot antenna are assembled together and the antenna is tested to determine the resonant frequencies thereof with the dimensions of the metallization and the slot on the top level and the dimensions of the metallization on the second level being adjusted to provide the antenna with the desired dual resonant frequencies. The first circuit and the second circuit are initially sized to produce resonant frequencies offset from the desired frequency. The tabs are then adjusted in dimension by removal of a portion thereof to provide the required tuning.

The above described embodiment suffers from the problem that it is only capable of removal of tab metallization for frequency adjustment and therefore the frequency of the antenna elements can be adjusted over the length of the tab only.

SUMMARY OF THE INVENTION

In accordance with the present invention, one or both of the tabs in accordance with the above described embodiment are replaced by slots which are indentations in one or both of the metallization on one surface comprising the ground plane and an antenna element. These slots can be enlarged by removal of metallization and can be diminished in size by securing, such as by soldering, an electrically conductive foil over a portion of the slot. The foil can be trimmable and is preferably copper. Changes in frequency appear to result predominantly from changing the size of the slots (removal of metallization) in a direction normal to the axes of the slots, this being in a direction away from the other metallization on the surface. Opposing slots in the ground plane and antenna element metallization are generally coaxial and of rectangular shape.

BRIEF DESCRIPTION OF THE DRAWINGS

FIG. 2 is a perspective view of the antenna of FIG. 1 in assembled form mounted on a host surface;

FIG. 3 is a top view of the topmost surface of an antenna in accordance with the present invention;

FIG. 4 is an enlarged view of one of the foil containing regions of FIG. 3;

FIG. 5 is a top view of a second embodiment of one of the foil containing regions of FIG. 3;

FIG. 6 is a top view of a third embodiment of one of the foil containing regions of FIG. 3;

FIG. 7 is a graph showing typical changes in resonant frequency of a dual frequency cavity backed slot antenna with adjustment in the dimensions of the inwardly and outwardly extending tabs and/or foil; and FIG. 8 is a top view of a fourth embodiment in accordance with the present invention.

DESCRIPTION OF THE PREFERRED EMBODIMENT

Figure 1:
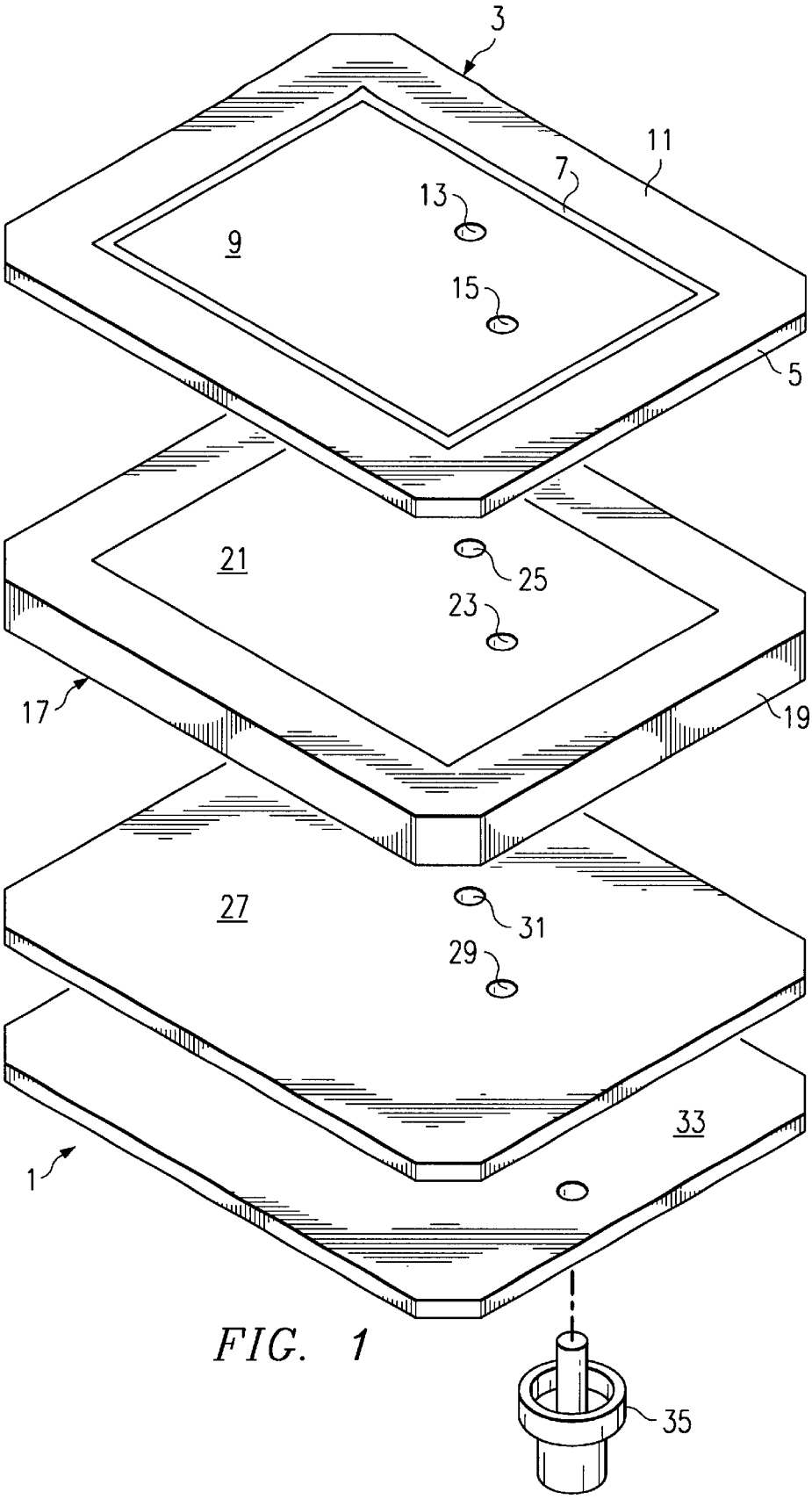
FIG. 1 is an exploded view of a dual frequency cavity backed slot antenna prior to tab formation.

Referring first to FIG. 1, there is shown an exploded view of a cavity backed dual frequency slot antenna 1. The antenna 1 includes four levels, the top level 3 including a substrate 5 of electrically insulating material, typically TMM-10, having a relative dielectric constant of about 10. The top surface of the level 3 includes a radiating slot 7 with metallization 9 within the slot and metallization 11 external to the slot. The metallization 9 is dimensioned to provide a first predetermined resonant frequency and the metallization 11 provides the ground plane and extends to the edges of the substrate 5. Feed throughs (not shown) terminate at terminations 13 and 15. A second level 17 includes a substrate 19 of electrically insulating material having a relative dielectric constant of about 10, typically TMM-10, with a patch of metallization 21 in the central region thereof which does not extend to the edge of the substrate and metallization on the back side thereof (not shown). A pair of apertures 23 and 25 are provided through the metallization 21 and the metallization on the back side for the feed probes (not shown). The third layer 27 is a stripline hybrid substrate of lower relative dielectric constant of about 3, typically TMM-3, having apertures 29 and 31 extending therethrough for the feed throughs (not shown) and the fourth layer 33 is similar to the third layer. A connector 35 connects the feed throughs to the antenna 1. The layers 27 and 33 are a standard stripline microwave circuit which forms a 90 degree hybrid which drives the antenna to circular polarization through the two feed probes as described in the above noted application.

Referring now to FIG. 2, there is shown the antenna 1 disposed in a cavity 41 of electrically conductive material which is electrically connected by conductive tape or other means to the metallization 11 and provides part of the ground plane. The cavity 41 retains the antenna 1 therein. The antenna 1 is disposed in a host 43, such as the wing of an airplane, and is positioned so that the topmost surface of the circuit 1 layer 3 is conformal to the host surface.

Referring now to FIGS. 3 and 4, there is shown the circuit 1 layer of the antenna of FIG. 1 with the inventive features therein according to a first embodiment. The upper surface 51 includes a slot 53 (corresponding to slot 7) with metallization 55 (corresponding to metallization 9) within the slot and metallization 57 (corresponding to metallization 11) exterior to the slot. The metallization 55 has outwardly extending tabs 61, better shown in FIG. 4, and the metallization 57 has an indented regions 58 into which the tabs 61 extend, better shown in FIG. 4.

In accordance with this embodiment, there is provided the same metallization 55 and 57 with slot 53 therebetween. The tab 61 is shown shortened for reasons which will be explained hereinbelow. The metallization 57 is lengthened within the indented regions 58 by securing electrically conductive foils 63 to the metallization 57 across each of the indented regions. The foil 63 can be dimensioned to add area where a tab is positioned in accordance with the above described prior art. Also, the foil, once positioned, can be reduced in area by trimming as in the case of the tab of the above described prior art. In this way, the effective dimensions of what amounts to the tab in the above described prior art and what is the indent in the present invention can be easily increased or decreased at the surface of the antenna structure either by (1) initial dimensioning of the conductive foil to be utilized and/or (2) the positioning of the conductive foil relative to the metallization with which it makes contact and/or (3) trimming of the conductive foil after it has been affixed to the metallization to form an indentation in the combined metallization and conductive foil. The distance "f" from the edge of tab 61 to the metallization 55 determines the $L_1$ resonant frequency and the distance "d" from the edge of the foil 63 to the slot 53 determines the $L_2$ resonant frequency and is not affected by the position of tab 61.

The antenna is tested to determine the two resonant frequencies thereof. If the resonant frequencies are intentionally tuned low, the antenna is tuned by shortening the tab 61, as required, and shortening the tab 59, as required. In the event one of the tabs 59 and/or 61 must be lengthened, a conductive foil such as foil 63 is secured to the tab to be lengthened and the foil is then shortened to the desired dimension.

Shortening of tab 61 will cause an increase in the two resonant frequencies $L_1$ and $L_2$ of the antenna, shortening of tab 59 will cause a decrease in the $L_2$ resonant frequency with the $L_1$ resonant frequency being substantially unaffected and lengthening of tab 59 will cause an increase in the $L_2$ resonant frequency with the $L_1$ resonant frequency being substantially unaffected.

Referring now to FIG. 5, there is shown a second embodiment in accordance with the present invention. In this embodiment, the conductive foil 63 of FIG. 4 is replaced by a tab 65 and the tab 61 of FIG. 4 is replaced by a conductive foil 67. Conductive foil 67 performs the functions attributed to the tab 61 as discussed above. The above discussion relative to the conductive foil 63 applies as well to the conductive foil 67.

Referring now to FIG. 6, there is shown a third embodiment in accordance with the present invention. In this embodiment, the conductive foil of FIG. 4 is retained and the tab 61 is replaced by the tab 67 as in FIG. 5. It can be seen that this embodiment is a combination of the embodiments of FIGS. 4 and 5.

Referring now to FIG. 7, there is shown a graph of the change in antenna resonant frequency with change in tab length and/or conductive foil dimensions. It can be seen that trimming of the conductive foil 63 of FIG. 4, provides a continual lowering of the resonant frequency $L_2$ and essentially no change in the resonant frequency $L_1$ whereas trimming of the outwardly directed tab, such as tab 61, of FIG. 4 causes a continual increase in the resonant frequency of both $L_1$ and $L_2$. Accordingly, by trimming (or enlarging) the dimensions of the tabs 59 and 65 and/or foils 63 and 67, an adjustment of the resonant frequency of either $L_1$ or $L_2$ or both can be provided.

Referring now to FIG. 8 there is shown a fourth embodiment of the invention. In accordance with this embodiment, the tabs and conductive foils as shown in FIGS. 4 to 6 are replaced by indentations 71 and 73. The resonant frequencies $L_1$ and $L_2$ are determined by the dimensions of the indentations 71 and 71. These resonant frequencies can be altered by removal and/or addition of metallization into and/or from the indentations. A foil can be used in conjunction with this embodiment as described in connection with FIGS. 4 to 6. However, in this case, the foil would be used only in the case of an error wherein some metallization is unintentionally removed, the foil replacing the unintentionally removed metallization.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modification.

What is claimed is:

1. A dual frequency cavity backed slot antenna comprising:

(a) a plurality of stacked layers including a layer having a substrate with a surface, said surface including thereon:
  (i) a continuous slot;
  (ii) first electrically conductive metallization disposed internal of said slot and extending to said slot;
  (iii) second electrically conductive metallization disposed external to said slot and extending to said slot, said first and second electrically conductive metallization defining said slot; and
  (iv) at least one pair of axially aligned frequency adjusting means, said pair of frequency adjusting means comprising:
    (a) a first tab or indentation forming a part of said first electrically conductive metallization; and
    (b) a second tab or indentation forming a part of said second metallization and axially aligned with said first tab or indentations;
    (c) at least part of at least one of said first or second tab or indentation including a separate trimmable electrically conductive layer secured to its associated metallization.

2. The antenna of claim 1 wherein said pair of frequency adjusting means are each indentations, at least one of said indentations being disposed in said separate trimmable electrically conductive layer.

3. The antenna of claim 1 wherein said trimmable electrically conductive tab or indentation is a metal foil.

4. The antenna of claim 2 wherein said trimmable electrically conductive tab or indentation is a metal foil.

5. A dual frequency cavity backed slot antenna comprising:

(a) a plurality of stacked layers including a layer having a substrate with a surface, said surface including thereon:
  (i) a continuous slot;
  (ii) first electrically conductive metallization disposed internal of said slot and extending to said slot;
  (iii) second electrically conductive metallization disposed external to said slot and extending to said slot, said first and second electrically conductive metallization defining said slot; and
  (iv) at least one pair of axially aligned frequency adjusting means, said pair of frequency adjusting means comprising:
    (a) an indentation forming a part of one of said first and second electrically conductive metallization; and
    (b) a tab forming a part of the other of said first and second electrically conductive metallization and axially aligned with said indentation;
    (c) at least one of said tab or indentation including a separate trimmable electrically conductive layer secured to its associated metallization.

6. The antenna of claim 5 wherein said indentation is a part of said first metallization and said tab is a part of said second metallization and extends outwardly toward said second metallization.

7. The antenna of claim 5 wherein said trimmable electrically conductive tab is a metal foil.

8. The antenna of claim 6 wherein said trimmable electrically conductive tab is a metal foil.

9. A method of tuning a dual frequency cavity backed slot antenna comprising the steps of:

(a) providing a plurality of stacked layers including a layer having a substrate with a surface, said surface including thereon:
  (i) a continuous slot;
  (ii) first electrically conductive metallization disposed internal of said slot and extending to said slot;
  (iii) second electrically conductive metallization disposed external to said slot and extending to said slot, said first and second electrically conductive metallization defining said slot; and
  (iv) at least one pair of axially aligned frequency adjusting means, said pair of frequency adjusting means comprising a first tab or indentation forming a part of said first electrically conductive metallization and a second tab or indentation forming a part of said second electrically conductive metallization, at least part of at least one of said first or second tab or indentation including a separate trimmable electrically conductive layer secured to its associated metallization; and (b) altering the dimensions of said trimmable electrically conductive layer to adjust the frequency of said antenna.

10. The method of claim 9 wherein said frequency adjusting means comprises at least one indentation of rectangular shape.

11. A method of tuning a dual frequency cavity backed slot antenna comprising the steps of:

(a) providing a substrate with a surface, said surface including thereon:

(i) a continuous slot;

(ii) first electrically conductive metallization disposed internal of said slot and extending to said slot;

(iii) second electrically conductive metallization disposed external to said slot and extending to said slot, said first and second electrically conductive metallization defining said slot; and (iv) at least one pair of axially aligned frequency adjusting means, said pair comprising one of an indentation or a tab in each of said first and second electrically conductive metallization; and (b) then altering the dimensions of at least one of said tabs or indentations to adjust the frequency of said antenna.

12. The method of claim 11 wherein said step of altering comprises one of trimming metallization from or adding metallization to said at least one of said tabs or indentations.

13. The method of claim 12 wherein said pair of frequency adjusting means are both tabs.

14. The method of claim 12 wherein one of said pair of frequency adjusting means is a tab and the other is an indentation.

15. The method of claim 12 wherein said pair of frequency adjusting means are both indentations.

* * * * *